US008688297B2

(12) United States Patent
Morris

(10) Patent No.: US 8,688,297 B2
(45) Date of Patent: Apr. 1, 2014

(54) METHODS AND SYSTEMS FOR CONTINUALLY MEASURING THE LENGTH OF A TRAIN OPERATING IN A POSITIVE TRAIN CONTROL ENVIRONMENT

(75) Inventor: Charles W. Morris, Nokesville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 163 days.

(21) Appl. No.: 13/292,621

(22) Filed: Nov. 9, 2011

(65) Prior Publication Data

US 2012/0116616 A1 May 10, 2012

Related U.S. Application Data

(60) Provisional application No. 61/412,036, filed on Nov. 10, 2010.

(51) Int. Cl.
*G05D 1/00* (2006.01)
*G01S 19/23* (2010.01)

(52) U.S. Cl.
USPC ..... 701/19; 342/357.62

(58) Field of Classification Search
USPC ..... 701/2, 22; 455/130; 342/357.66, 357.62
See application file for complete search history.

(56) References Cited

U.S. PATENT DOCUMENTS

| | | | | |
|---|---|---|---|---|
| 3,641,338 | A | 2/1972 | Peel et al. | |
| 4,582,280 | A | 4/1986 | Nichols et al. | |
| 5,129,605 | A | 7/1992 | Burns et al. | |
| 5,893,043 | A | 4/1999 | Moehlenbrink et al. | |
| 6,218,961 | B1 | 4/2001 | Gross et al. | |
| 6,580,976 | B1 | 6/2003 | Belcea | |
| 7,162,337 | B2 | 1/2007 | Peltz et al. | |
| 7,395,141 | B1 | 7/2008 | Seck et al. | |
| 7,610,152 | B2 | 10/2009 | Meyer | |
| 2005/0107954 | A1 | 5/2005 | Nahla | |
| 2005/0240322 | A1 | 10/2005 | Peltz et al. | |
| 2007/0233335 | A1 * | 10/2007 | Kumar et al. | 701/22 |
| 2008/0097659 | A1 | 4/2008 | Hawthorne | |
| 2008/0128562 | A1 | 6/2008 | Kumar et al. | |
| 2008/0167767 | A1 | 7/2008 | Brooks et al. | |
| 2008/0195265 | A1 | 8/2008 | Searle et al. | |
| 2008/0243320 | A1 | 10/2008 | Otsubo et al. | |
| 2008/0312775 | A1 | 12/2008 | Kumar | |
| 2009/0017782 | A1 * | 1/2009 | Monat et al. | 455/130 |
| 2009/0043435 | A1 | 2/2009 | Kane et al. | |
| 2009/0090818 | A1 | 4/2009 | Kumar | |
| 2009/0177344 | A1 | 7/2009 | James et al. | |

(Continued)

FOREIGN PATENT DOCUMENTS

DE 19628124 1/1998

OTHER PUBLICATIONS

Australian Office Action, Application Number 2011250693, mailed Sep. 27, 2013, 3 pages.

*Primary Examiner* — Muhammad Shafi
(74) *Attorney, Agent, or Firm* — Hamre, Schumann, Mueller & Larson, P.C.

(57) ABSTRACT

Methods and systems for continually measuring the length of a train operating in a positive train control environment are provided. Particularly, the methods and systems provided herein equate repetitive line of sight ranging measurements from the head end to the rear end of a train with the physically draped length of the train along a mapped track with various horizontal and vertical curvature characteristics.

17 Claims, 2 Drawing Sheets

(56) References Cited

U.S. PATENT DOCUMENTS

2009/0186325 A1 7/2009 Kumar
2010/0235020 A1 9/2010 Meyer et al.
2011/0010022 A1* 1/2011 Beavin ..... 701/2
2011/0037651 A1* 2/2011 Oehler ..... 342/357.66

* cited by examiner

*Fig. 2*

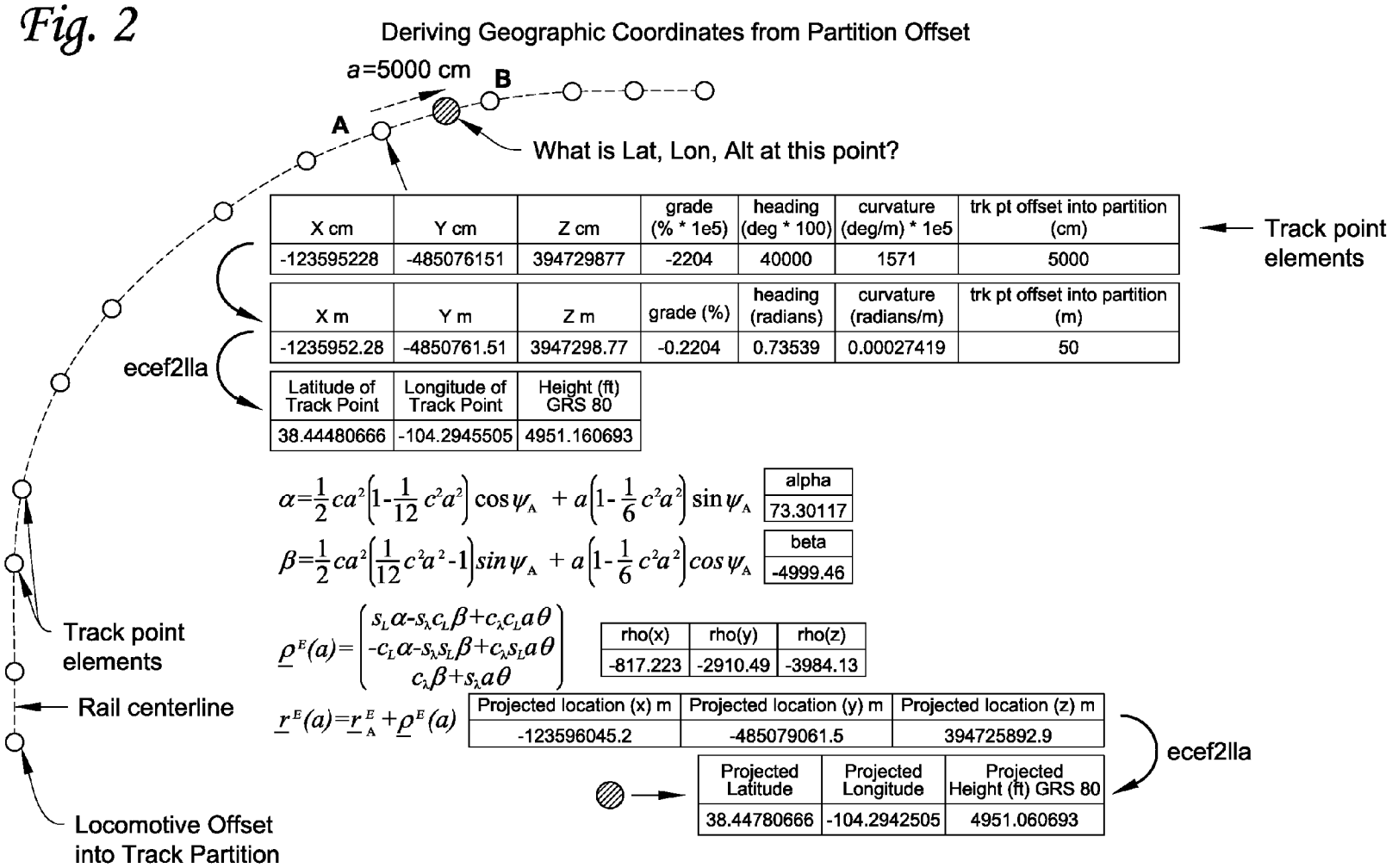

| X cm | Y cm | Z cm | grade (% * 1e5) | heading (deg * 100) | curvature (deg/m) * 1e5 | trk pt offset into partition (cm) |
|---|---|---|---|---|---|---|
| -123595228 | -485076151 | 394729877 | -2204 | 40000 | 1571 | 5000 |

| X m | Y m | Z m | grade (%) | heading (radians) | curvature (radians/m) | trk pt offset into partition (m) |
|---|---|---|---|---|---|---|
| -1235952.28 | -4850761.51 | 3947298.77 | -0.2204 | 0.73539 | 0.00027419 | 50 |

| Latitude of Track Point | Longitude of Track Point | Height (ft) GRS 80 |
|---|---|---|
| 38.44480666 | -104.2945505 | 4951.160693 |

$$\alpha=\frac{1}{2}ca^2\left(1-\frac{1}{12}c^2a^2\right)\cos\psi_A+a\left(1-\frac{1}{6}c^2a^2\right)\sin\psi_A$$

$$\beta=\frac{1}{2}ca^2\left(\frac{1}{12}c^2a^2-1\right)\sin\psi_A+a\left(1-\frac{1}{6}c^2a^2\right)\cos\psi_A$$

| alpha |
|---|
| 73.30117 |

| beta |
|---|
| -4999.46 |

$$\underline{\rho}^E(a)=\begin{pmatrix} s_L\alpha-s_\lambda c_L\beta+c_\lambda c_L a\theta \\ -c_L\alpha-s_\lambda s_L\beta+c_\lambda s_L a\theta \\ c_\lambda\beta+s_\lambda a\theta \end{pmatrix}$$

| rho(x) | rho(y) | rho(z) |
|---|---|---|
| -817.223 | -2910.49 | -3984.13 |

$$\underline{r}^E_A(a)=\underline{r}^E_A+\underline{\rho}^E(a)$$

| Projected location (x) m | Projected location (y) m | Projected location (z) m |
|---|---|---|
| -1235960.45.2 | -485079061.5 | 3947258892.9 |

| Projected Latitude | Projected Longitude | Projected Height (ft) GRS 80 |
|---|---|---|
| 38.44780666 | -104.2942505 | 4951.060693 |

METHODS AND SYSTEMS FOR CONTINUALLY MEASURING THE LENGTH OF A TRAIN OPERATING IN A POSITIVE TRAIN CONTROL ENVIRONMENT

This application claims the benefit of priority of U.S. Provisional Application No. 61/412,036, filed on Nov. 10, 2010, and entitled METHODS AND SYSTEMS FOR CONTINUALLY MEASURING THE LENGTH OF A TRAIN OPERATING IN A POSITIVE TRAIN CONTROL ENVIRONMENT, and which is herewith incorporated by reference in its entirety.

FIELD

This disclosure relates to the field of train traffic control systems. More particularly, this description relates to methods and systems for continually measuring the length of a train operating in a positive train control environment.

BACKGROUND

Conventional train traffic control systems use physical electric blocks & require physical circuits to sense (via short circuiting action of the train wheels/axles) that it is safe for following trains to enter a section of track. When migrating over to Positive Train Control systems, needs include a reliable and highly available method to determine that the leading train has not separated (i.e. maintain train integrity). Having real-time train integrity status allows the full capacity of the train network to be better realized.

Commercially proposed methods offered include mounting a global positioning system (GPS) Receiver on the rear car of the train to monitor train speed at the rear, and monitoring train brake pipe pressure as an indirect indication that the train has not physically separated. GPS alone is not effective since sky coverage from the rear coupler of the last car on a train is very limited, and in wooded areas can be nonexistent for unacceptably long periods of time. In addition, GPS visibility is variable with time of day (e.g. 5-12 satellites in an open area without nearby obstructions, depending on constellation state and user location). Typically, four satellites are required for a position solution to be computed.

Monitoring brake pipe pressure is helpful, but if an anglecock is closed somewhere along the train line, then the pressure at the rear car can remain high. Also, if the break in two occurs between cars ahead of where the anglecock was closed, air is captured in the section between the cars. That is, the telemetry data from the End of Train Device (ETD) will indicate normal air pressure is present at the end of the train, but the rear section of the train may still be separated from the head end section.

SUMMARY

This application describes methods and systems for continually measuring the length of a train operating in a positive train control environment. Particularly, the methods and systems provided herein equate repetitive radio frequency (RF) based line-of-sight ranging measurements from the head end to the rear end with the physically draped length of the train along a mapped track with various horizontal and vertical curvature characteristics.

The embodiments described herein provide methods and systems for monitoring the total train length without the use of GPS based devices on the rear of train, accelerometers, track circuit occupancies, or brake pipe pressure indications to infer train integrity. Also, the embodiments described herein provide a portable, integrated, highly available and reliable system and method that works without track circuits in order to detect a break-in-two (unplanned physical train separation) in a real-time, continuous manner.

The embodiments described herein allow a train fitted with an operational location determination unit (LDU) and an onboard track database, such as a Lockheed Martin onboard track database, to monitor its integrity (length along a non-tangent track) using a simple Line of Sight (LOS) rectilinear measurement. In some embodiments, the LDU is a rail guide sensor such as, for example, a Lockheed Martin Rail Guide Sensor.

In some embodiments, the head end unit of a train is equipped with a rail guide train tracking system. By running on a mapped track, the embodiments provided herein develop a unique offset value for the track partition the train is running on. In some embodiments, the mapped track is contained in an onboard track database. In some embodiments, the train, equipped with a rail guide train tracking system on the head end unit, such as a Lockheed Martin Rail Guide train tracking system, and running on a mapped track, develops a unique offset value for the t rack partition the train is running on. The mapped track is contained in an onboard track database. The rail guide train tracking system employs GPS, Inertial Data (ID), tachometer data, and the track database to determine track partition and offset into the partition, in real-time. In some embodiments, the LDU employs GPS, Inertial Data, tachometer data, and the track database to determine track partition and offset into the partition, in real-time.

A unique train length is established and validated within the rail guide train tracking system by determining the unique track partition ID and an offset into the partition, and comparing this to the train consist report created after the train is made up.

Using the track database model and coefficients loaded into the rail guide train tracking system, the offset at the rear of train into the partition is continually computed as the head end offset plus the length of train from, for example, the wheel report. Mathematical calculations are employed to develop the geographic coordinates that locate the rear of the train, based on the head end offset and train length, along the mapped track partition. These calculations consider the grade and curvature foreshortening that occurs.

In some embodiments, the rear of train track offset is converted into geographic coordinates (e.g. Latitude, Longitude, Altitude (LLA) coordinates). The geographic coordinates for the rear end of the train are converted into earth centered earth fixed (ECEF) Cartesian coordinates (X, Y, Z). Additional mathematical calculations are then used to develop a line of sight (LOS) vector of a specific length from the head end location in earth centered earth fixed (ECEF) Cartesian coordinates (X, Y, Z) to the rear end of the train in ECEF coordinates. In some embodiments, this unique vector range measurement is updated at a period between every 1 and 60 seconds.

A commercially available interrogator (e.g. a RF transmitter) sends a pulse from the head end unit, which is read by a transponder mounted at the rear of train, which is then turned around and transmitted back and read by the head end mounted interrogator. The interrogator notes the time interval between when the pulse was sent and when it was received, and determines a unique slant range distance to the rear of train mounted transponder. This measured distance is then compared with the anticipated LOS measurement developed by the rail guide tracking system. These distances are constantly monitored (e.g. every second, every 5 seconds, every 10 seconds, or every minute, etc.). If the train separates, the measured LOS length will gradually increase, and software monitoring in the rail guide tracking system will determine there is a growth of difference trend (slope) which appears to indicate a break-in-two.

The rail guide tracking system raises a flag which is sent to the locomotive engineer, which can then inspect other indications of a break, including visual and brake pipe pressure indications. If a break in-two is suspected, then the engineer can inform dispatch and the automatic train control authority management server of this condition, so that proper steps can be taken to reconfigure electronic block releases to protect all trains in the area.

In one embodiment, a system for determining the integrity of a train in real-time by continually monitoring a train length between a first car of the train and a second car of the train is provided. The system includes an interrogator at the first car of the train that transmits a communication signal, and a transponder at the second car of the train that receives the communication signal and transmits a receiving signal back to the interrogator. The system also includes a location determination unit coupled to the interrogator. The location determination unit is configured to calculate an actual line of sight distance based on the receiving signal, and calculate an expected slant range distance based on the location of the train on a mapped train track. The system determines the integrity of the train by comparing the actual line of sight distance with the expected line of sight distance.

In another embodiment, a method for determining the integrity of a train in real-time is provided. The method includes transmitting, via an interrogator disposed on a first car of the train, a communication signal to a transponder disposed on a second car of the train. Upon receiving the communication signal, the transponder transmits a receiving signal to the interrogator. The transponder receives the receiving signal and determines an actual slant range (i.e., line of sight) distance between the first car and the second car. A location determination unit, coupled to the interrogator, calculates an expected slant range distance between the first car and the second car that is determined based on the location of the train on a mapped train track. The method also includes comparing the actual slant range distance to the expected slant range distance to determine whether the integrity of the train is maintained.

DESCRIPTION OF THE DRAWINGS

FIG. 2 is a diagram illustrating one embodiment of deriving geographic coordinates from a partition offset.

DETAILED DESCRIPTION

Figure 1:
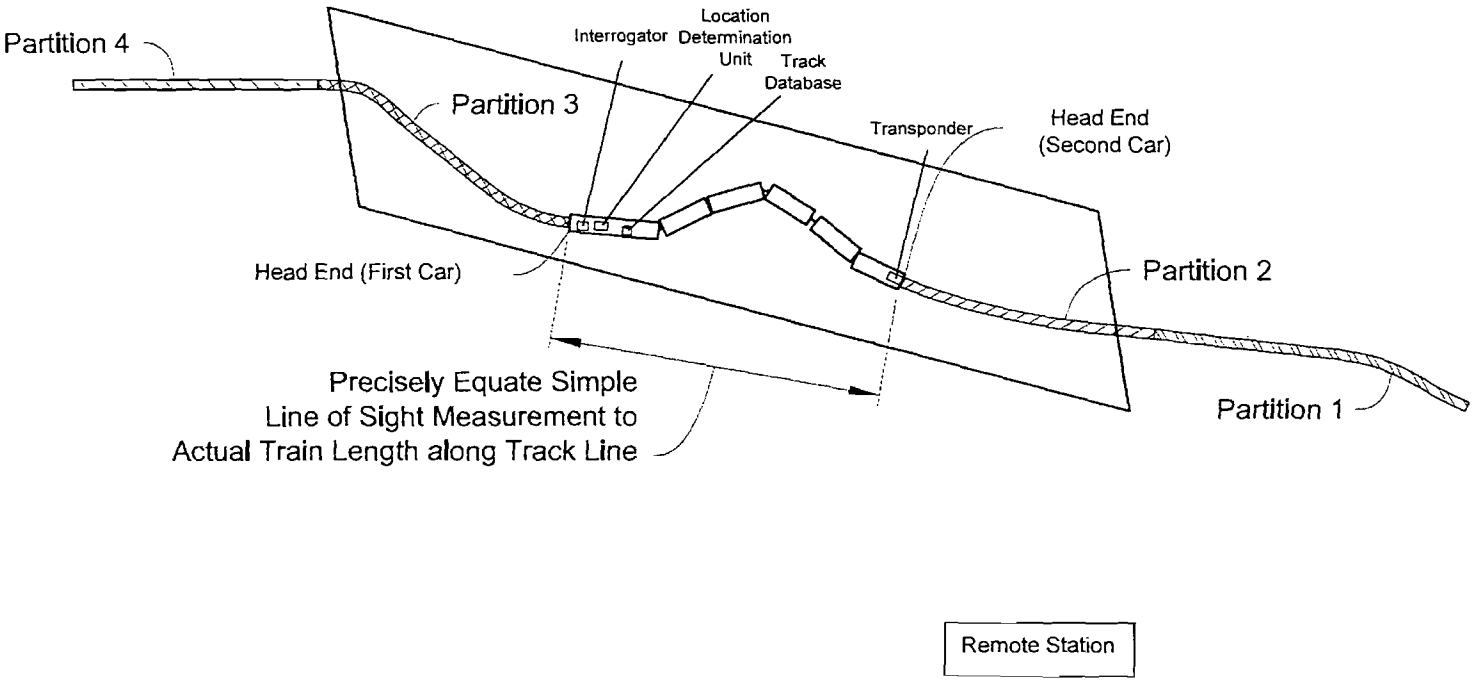
FIG. 1 is a diagram illustrating one embodiment of how comparing a LOS measurement to an actual train length along a track line.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice what is claimed, and it is to be understood that other embodiments may be utilized without departing from the spirit and scope of the claims. The following detailed description is, therefore, not to be taken in a limiting sense.

This embodiments described herein use a direct two way RF ranging system, being established between the head end locomotive's location determination unit (LDU) and rear end end-of-train device, to determine train integrity. Integrity in this context is verification that the physical length of the train is not appreciably changing, due to a break-in-two event. In some embodiments, the direct two way RF ranging system is similar to the system used in mines to locate crews down a mine shaft.

The embodiments described herein also use relevant track database elements, with the navigating LDU being resolved to an underlying track database, allowing it to continually compute an offset into a partition of a mapped track. The LDU concurrently computes, using the independently derived line-of-sight distance developed within the interrogator (based on round trip time of the pulse returned by the RF ranging transponder) the train's physical draped length on the track behind the head end, assuming the rear of train is also on mapped track.

The draped end-to-end length of the train (i.e. the physical consist length consisting of locomotives and cars) will differ from the RF based line-of sight length due to rail horizontal and vertical curvature. These conditions result in the line-of-sight length always being less than the physical consist length, except in rare cases when the train is completely on a tangent track.

Typically, as the train is made up, the consist (i.e. the locomotive and trailing cars that make up the train) and the initial length of the train are determined. Various methods can be used to determine initial train length. These can include, for example: using a wheel report (manifest) which knows the length of each numbered car from a database and sums the individual lengths into an overall train length; and monitoring train speed as outlying switch circuits are activated and de-activated by the train when leaving the make-up yard, and computing the length of the train as a function of speed and time internal of circuit activation to de-activation.

As shown in FIG. 1, the computed consist length is continually monitored from the time the train is assembled and initialized and compared with the 'wheel report' length as determined, for example, by an operations department. The head end, equipped with an LDU (integrated with an RF interrogator) continually evaluates the line-of-sight range to the rear car's transponder. Ranging measurements developed in the LDU (as the transponder reacted to the head end interrogator's received pulse being received) are repeated every 1-30 seconds. In some embodiments, the ranging transponder and the end-of-train-device that telemeters brake pipe pressure are battery powered. Therefore a timely indication can be obtained that the separation has occurred, since the ranging transponder mounted on the rear car would continue to operate for a period of time and continue to respond to the pulses received from the head end mounted interrogator.

Not all increases in line-of-sight length from the RF measurement system will signify a train separation event. For example, when the train is on a section of track with a high degree of horizontal curvature, and then moves forward to a location where the whole train is on tangent track. In gradually moving to the tangent track, the line-of-sight length will gradually increase in a particular manner (curvature and speed dependent) as the train is eventually 'straightened out'. In this example, the predicted amount of straightening that occurs over time as the train moves down this track section is continually computed from the relevant track database parameters and the pre-trip wheel report length. With this information, the RF line-of-sight measurement is constantly compared. If the computed line-of-sight length agrees with the line-of sight RF measurement within a tolerance threshold, then the train is considered 'whole'. Rates and trends are also developed and monitored, to accommodate train bunching and stretching which occurs in normal train handling.

The LDU is configured to retrieve the ECEF coordinates computed by the LDU, which is resolved to an underlying track database. The algorithm then steps down the track partition starting at the head end offset value, one discrete length at a time (e.g. every centimeter), incrementally in the direction the partition runs properly in context to which way the train is on it. At each incremental offset into partition, a synthesized rear end ECEF coordinate is computed, using parameters contained in the track database for this partition and specific mathematical equations as shown in FIG. 2.

For each pair of ECEF coordinates (e.g. a head end one based on actual offset computed by the LDU and a synthesized rear end one) a slant range line-of-sight range is computed, based on the shortest distance between two points in three dimensional space using the Pythagorean theorem. The line-of-sight vector between these two locations is determined as:

SQRT[(Xa−Xb)+(Ya−Yb)+(Za−Zb)]^2

In this example, "a" denotes a head end coordinate, and "b" denotes a rear end coordinate. The term "ecef2lla", shown in FIG. 2, is a conversion between ECEF coordinates and Latitude, Longitude, and Altitude (LLA) coordinates.

The track database coefficients are determined by post-processing track data obtained from a field survey. These are prepared ahead of time, and are loaded onto the LDU prior to a trip. As shown in FIG. 2, the track point elements for point A are first converted into units of radians and meters. The track point elements are then converted from ECEF coordinates into LLA coordinates. The LLA coordinates are then used to perform the LOS calculations, as described below.

The following track database parameters are now described:

Note: Offset from Point A in this example is 5000 cm.

Offset into Partition, a
x-ECEF coordinate, x
y-ECEF coordinate, y
z-ECEF coordinate, z
Grade, θ
Heading, ψ
Curvature, c Given the track database parameters at only one track point (i.e. A in FIG. 2), we have everything we need to reconstruct the ECEF coordinates at the track centerline center-line at Point B. The formulas are given below.

$$\alpha = \frac{1}{2}ca^2\left(1 - \frac{1}{12}c^2a^2\right)\cos\psi_A + a\left(1 - \frac{1}{6}c^2a^2\right)\sin\psi_A$$

$$\beta = \frac{1}{2}ca^2\left(\frac{1}{12}c^2a^2 - 1\right)\sin\psi_A + a\left(1 - \frac{1}{6}c^2a^2\right)\cos\psi_A$$

$$\underline{\rho}^E(a) = \begin{pmatrix} s_L\alpha - s_\lambda c_L\beta + c_\lambda c_L a\theta \\ -c_L\alpha - s_\lambda s_L\beta + c_\lambda s_L a\theta \\ c_\lambda\beta + s_\lambda a\theta \end{pmatrix}$$

$$\underline{r}^E(a) = \underline{r}_A^E + \underline{\rho}^E(a)$$

In the above formulas, the variable "a" is the distance beyond track point A (i.e. the distance from point A toward point B, and in the direction of increasing partition offset, along the track 3-D spline). In this example the distance is 5000 cm. Variable $\underline{r}_A^E$ is the 3 by 1 vector of ECEF coordinates stored at track point A, and ρ is the ECEF displacement vector to get to the centerline point at the distance a beyond point A. The 3 by 1 displacement vector $\rho^E$ (a) consists of X (top), Y (middle), and Z (bottom) equations. Each of these is evaluated as shown above, where L denotes Latitude, C denotes Cosine, S denotes Sine.

The other parameters are obtained as shown for alpha and beta and from the track database parameters themselves. The 3 by 1 vector variable $\underline{r}^E$(a) represents the ECEF coordinates at location B.

Knowing the ECEF coordinates at B allows for direct computation of the displacement between Point A (where the LDU resides) and Point B (where the end of train is located) along the track 3-D spline, using:

SQRT[(Xa−Xb)+(Ya−Yb)+(Za−Zb)]^2

The results of this final computation are repeatedly and directly compared (using appropriate units) to the LOS length measurement reported by the RF transponder system. In this embodiment, the computations are performed in the LDU on the train as the LOS measurement and the track database are also on the train. However, in other embodiments, the computations can be performed anywhere including at a remote station. If the computations are performed at a remote system, the results would need to be sent to the train to inform the operator that a break in the train has been detected, which could result in latency and reduced reliability/availability issues stemming from communication limitations between the train and the remote station.

This process is continued until the computed range=the measured range (±some tolerance). At this point, the rear end to head end offset (into their respective partitions) relative value is made. This single value represents the actual length of the train. This can first be determined in the yard, after the train is made up, the Location Determination System (LDS) is mapped to track, and the rear end is on a mapped track.

Once done, and the computed length agrees within tolerance to a consist wheel report length (i.e. manifest), then an instrument confirmation has been obtained. This can be sent to the crew. From hence forth on the trip, the process goes into repeated measurement mode, where the RF measurement made, and transformed using the process described above back into offset valid for the track profile that the train is draped on. This offset value should be equal to overall train length. When a break in two occurs, the distance mismatch will build rapidly, and the LDU will notify the crew and train control central office as required by the overall design of the system.

Having the ability to fleet trains using the concept of electronic blocks allows for rail traffic and revenue to be increased without laying additional track and installing additional conventional signaled blocks spaced more closely together. In order to fleet trains, the systems that manage these movements need highly available and reliable status on the integrity of each train in the system, so that following trains are not directed into the rear of a train ahead that have pulled in two. The method and systems provided herein do not require track circuit infrastructure and overhead logic. Moreover, the embodiments described herein avoid relying on GPS signal reception at the rear of train and the less than required operational availability it would entail, based on right of way obscurations and time-of-day (e.g. a GPS satellite constellation phenomena). Thus, the reliability of the embodiments described herein is primarily a function of the reliability of the components used, the availability of a track database, and the navigation of the head end LDU.

In some embodiments, ranging transponders can be attached to each trailing car, each with a unique ID. Having a head end mounted interrogator capable of transmitting many (e.g. hundreds) of unique codes for the train, the location of each car in the train could be continually evaluated, sequentially. This would be valuable in train handling as relative buff and draft (stretching and bunching) forces could be calculated. Also, this embodiment could be used to detect when excessive braking was occurring (along a sharp curve) and when too much stretching was occurring in a section of the train (cresting a hill under acceleration). In addition, knowing this information, an unplanned break in two could be identified in terms of where in the train (the distance and transponder ID) that the break in two occurred, thereby saving time.

The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A system for determining the integrity of a train in real-time by continually monitoring a train length between a first car of the train and a second car of the train, the system comprising:

an interrogator at the first car of the train that transmits a communication signal;

a transponder at the second car of the train that receives the communication signal and transmits a receiving signal back to the interrogator;

a location determination unit coupled to the interrogator, the location determination unit is configured to calculate an actual line of sight distance based on the receiving signal, and calculate an expected line of sight distance based on the location of the train on a mapped train track;

wherein the system determines the integrity of the train by comparing the actual line of sight distance with the expected line of sight distance.

2. The system of claim 1, further comprising a track database coupled to the location determination unit, the track database storing track parameter data of the mapped track including track offset data, location data, grade data, heading data and curvature data at a plurality of track point elements on the mapped train track.

3. The system of claim 1, wherein the interrogator is a radio frequency interrogator that transmits a radio frequency communication signal and the transponder is a radio frequency transponder that transmits a radio frequency receiving signal.

4. The system of claim 1, wherein the location determination unit is a rail guide sensor.

5. The system of claim 1, wherein the system determines the integrity of the train by comparing the actual line of sight distance with the expected line of sight distance at least every thirty seconds while the train is in operation.

6. The system of claim 1, wherein the location determination unit is configured to calculate track parameter data of the mapped track including track offset data, location data, grade data, heading data and curvature data at a plurality of track point elements on the mapped train track.

7. The system of claim 1, wherein the location determination unit is configured to determine the integrity of the train by comparing the actual line of sight distance with the expected line of sight distance.

8. The system of claim 1, further comprising a remote station that is configured to compare the actual line of sight distance with the expected line of sight distance to determine the integrity of the train.

9. The system of claim 1, wherein the system is configured to determine that the integrity of the train is maintained when a difference between the actual line of sight distance and the expected line of sight distance is less than or equal to a tolerance threshold value.

10. A method for determining the integrity of a train in real-time, the method comprising:

transmitting, via an interrogator disposed on a first car of the train, a communication signal to a transponder disposed on a second car of the train;

upon receiving the communication signal, the transponder transmitting a receiving signal to the interrogator;

the transponder receiving the receiving signal and determining an actual line of sight distance between the first car and the second car;

calculating, via a location determination unit coupled to the interrogator, an expected line of sight distance between the first car and the second car that is determined based on the location of the train on a mapped train track;

comparing the actual line of sight distance to the expected line of sight distance to determine whether the integrity of the train is maintained.

11. The method of claim 10, further comprising determining that the integrity of the train is maintained when a difference between the actual line of sight distance and the expected line of sight distance is less than or equal to a tolerance threshold value.

12. The method of claim 10, wherein determining the actual line of sight distance includes computing the time period between the interrogator sending the communication signal and the interrogator receiving the receiving signal.

13. The method of claim 10, wherein determining the expected line of sight distance includes:

determining an actual real-time position of the first car on the mapped train track;

calculating a derived real-time position of the second car using track parameter data of the mapped train track;

calculating the expected line of sight distance based on the actual real-time position of the first car and the derived real-time position of the second car.

14. The method of claim 13, wherein the track parameter data includes track offset data, location data, grade data, heading data and curvature data at a plurality of track point elements on the mapped train track.

15. The method of claim 13, further comprising the location determination unit calculating track parameter data of the mapped track including track offset data, location data, grade data, heading data and curvature data at a plurality of track point elements on the mapped train track.

16. The method of claim 10, wherein the interrogator is a radio frequency interrogator, the transponder is a radio frequency transponder, the communication signal is a radio frequency communication signal and the receiving signal is a radio frequency communication signal.

17. The method of claim 10, wherein comparing the actual line of sight distance to the expected line of sight distance is performed at least every thirty seconds while the train is in operation.

* * * * *